US005884128A

United States Patent [19]

Park

[11] Patent Number: 5,884,128

[45] Date of Patent: Mar. 16, 1999

[54] LIQUID CARRIER RECOVERY APPARATUS FOR LIQUID ELECTROPHOTOGRAPHIC PRINTER

[75] Inventor: Gyeong-ho Park, Suwon, Rep. of Korea

[73] Assignee: Samsung Electronics Co., Ltd., Kyungki-Do, Rep. of Korea

[21] Appl. No.: 82,009

[22] Filed: May 20, 1998

[30] Foreign Application Priority Data

Aug. 27, 1997 [KR] Rep. of Korea ..... 1997-41603

[51] Int. Cl.[6] ..... G03G 15/10

[52] U.S. Cl. ..... 399/250

[58] Field of Search ..... 399/249, 250, 399/348; 261/123, 122.1; 430/117–119

[56] References Cited

U.S. PATENT DOCUMENTS 3,991,709 11/1976 Sato et al. ..... 399/348 X 4,462,675 7/1984 Moraw et al. ..... 399/250

5,708,938 1/1998 Takeuchi et al. ..... 399/250

5,737,674 4/1998 Venkatesan et al. ..... 399/250

*Primary Examiner*—S. Lee

*Attorney, Agent, or Firm*—Sughrue, Mion, Zinn, Macpeak & Seas, PLLC

[57] ABSTRACT

A liquid carrier recovery apparatus for a liquid electrophotographic printer includes a drying unit for evaporating a liquid carrier, a condensing vessel in which a condensed carrier is stored, a circulating tube for reciprocally circulating the liquid carrier in the condensing vessel between the drying unit and the condensing vessel so that heat exchange occurs between the liquid carrier and the gas carrier within the drying unit, and a carrier reservoir for receiving and storing the gas carrier condensed in the drying unit and the condensing vessel.

8 Claims, 3 Drawing Sheets

LIQUID CARRIER RECOVERY APPARATUS FOR LIQUID ELECTROPHOTOGRAPHIC PRINTER

BACKGROUND OF THE INVENTION

1. Field of the Invention

The present invention relates to a liquid electrophotographic printer, and more particularly, to a carrier recovery apparatus for recovering a liquid carrier of a developer liquid adsorbed onto a photoreceptor.

2. Description of the Related Art

In general, in a liquid electrophotographic printer employed in a laser printer or a copier, an image formed on a photoreceptor such as a photoreceptor belt is developed using a developer liquid which is a mixture of a toner powder having a predetermined color and a liquid carrier. The developed image is transferred to and printed onto a sheet of paper after the liquid carrier is removed therefrom.

The liquid carrier, made of carbon hydroxide, is a pollutant and harmful to humans. Thus, it is desirable to recover the liquid carrier for recycling.

Referring to FIG. 1 showing a conventional liquid carrier recovery apparatus, a liquid carrier in the developer liquid supplied to an electrostatic latent image formed on a traveling photoreceptor belt 11 is evaporated by a drying roller 122 installed in a drying unit 12, and a heating roller 123 for heating the drying roller 122.

Part of the evaporated carrier contacts a heat transmission fin 121*a* formed in a housing 121, thereby being cooled and liquefied. The liquefied carrier is recovered through a first recovery tube 124 and stored in a carrier reservoir 15. Any evaporated carrier remaining in the housing 121 is sent to a condenser 14 by a fan 13*a* driven by a driving motor 13*b*. The gas carrier introduced into the condenser 14 contacts a condensed carrier maintained at a constant temperature, thereby being cooled and liquefied. The liquefied carrier is recovered through a second recovery tube 141 and stored in the carrier reservoir 15.

Part of the evaporated carrier introduced into the condenser 14 remains in a gaseous state. This gas carrier is filtered by a filter 161 installed in an exhaust unit 16 to prevent the carrier from effusing into the outside environment.

In the conventional carrier recovery apparatus, the cooling capacity of the heat transmission fin 121*a* is small. Thus, a negligible amount of carrier is liquefied within the drying unit 12, and most of the gas carrier is condensed in the condenser 14. Consequently, the time required for recovering the carrier is long, and the carrier recovery efficiency is low.

SUMMARY OF THE INVENTION

It is an object of the present invention to provide a carrier recovery apparatus for a liquid electrophotographic printer with an improved carrier recovery efficiency.

To achieve the above objective, the present liquid carrier recovery apparatus comprises: a drying unit for evaporating a liquid carrier adsorbed onto the surface of a photoreceptor belt to convert the same into a gas carrier; a condensing vessel in which a condensed carrier is stored, for condensing the gas carrier; a circulating tube connected to the drying unit and the condensing vessel, for reciprocally circulating the liquid carrier in the condensing vessel between the drying unit and the condensing vessel so that heat exchange occurs between the liquid carrier and the gas carrier; and a carrier reservoir for receiving and storing the liquid carrier condensed in the drying unit and the condensing vessel.

The drying unit includes a housing for accommodating the gas carrier, the input and output ends of the circulating tube are connected to the condensing vessel, respectively, and at least part of the circulating tube is coupled to the housing to be in contact therewith.

The liquid carrier recovery apparatus further comprises a flux tube for supplying the gas carrier of the housing to the condensing vessel, and whose output end is immersed in the liquid carrier in the condensing vessel. A porous member for distributing the gas carrier into the liquid carrier in a bubble state is coupled to the output end of the flux tube.

The above and other features of the invention including various and novel details of construction and combination of parts will now be more particularly described with reference to the accompanying drawings and pointed out in the claims. It will be understood that the particular liquid carrier recovery apparatus embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENT

Figure 1:
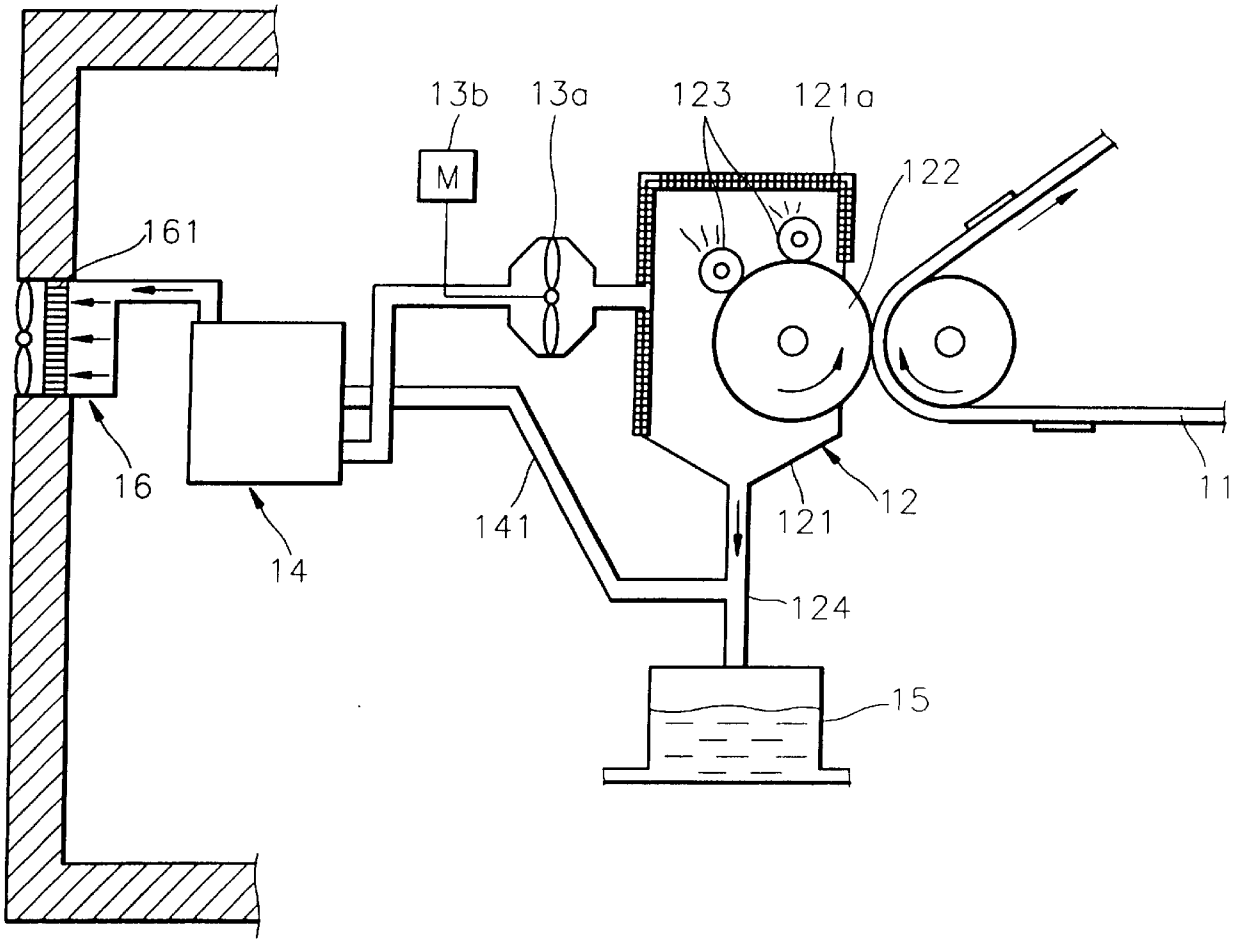
FIG. 1 (PRIOR ART)
FIG. 1 is a schematic diagram of a conventional liquid carrier for a liquid electrophotographic printer.
Figure 2:
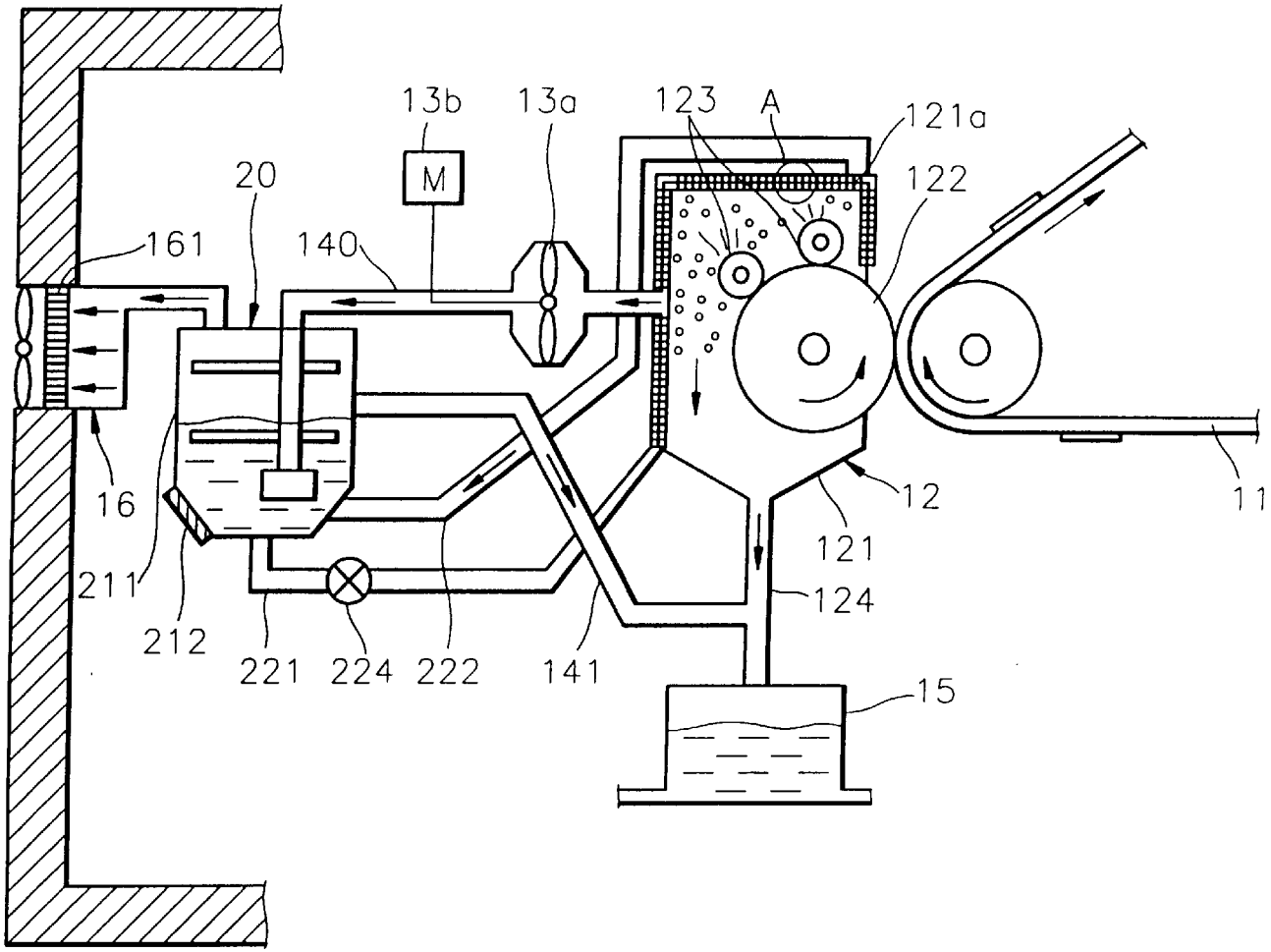
FIG. 2 is a schematic diagram of a liquid carrier for a liquid electrophotographic printer according to the present invention.

FIG. 2 shows a carrier recovery apparatus according to an embodiment of the present invention. Component parts which are the same as those illustrated in FIG. 1 are designated by the same reference numerals.

Referring to FIG. 2, the present carrier recovery apparatus includes a drying unit 12 for evaporating a carrier from a developer liquid adsorbed onto a surface of the photoreceptor belt 11, a condenser 20 for liquefying the gas carrier evaporated by the drying unit 12, and a carrier reservoir 15 in which the liquid carrier liquefied in the condenser 20 is recovered.

The drying unit 12 includes a drying roller 122 contacting the photoreceptor belt 11 and a heating roller 123 contacting the drying roller 122, for heating the same. Also, heat transmission fins 121*a* are formed in a housing 121 of the drying unit 12, so that the gas carrier is preliminarily cooled when the gas carrier contacts the heat transmission fins 121*a*.

The condenser 20 includes a condensing vessel 211 in which the gas carrier received from the drying unit 12 is liquefied and temporarily stored. The condensing vessel 211 is connected to the housing 121 of the drying unit 12 through a flux tube 140. A flux fan 13*a*, rotated by a driving motor 13*b*, is installed in the flux tube 140.

Figure 3:
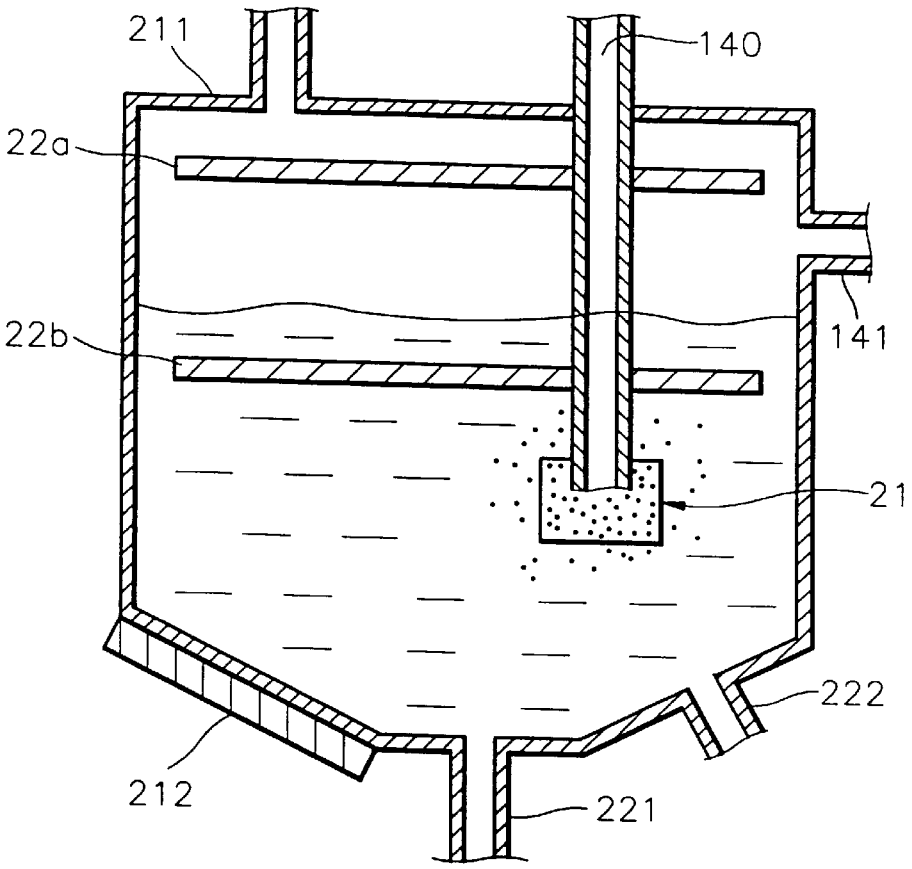
FIG. 3 is a schematic cross-sectional view of a condenser of the liquid carrier recovery apparatus shown in FIG. 2.

Referring to FIG. 3, an output end of the flux tube 140 is immersed in the condensed carrier stored in the condensing vessel 211. The output end of the flux tube 140 is coupled to a porous member 21. Accordingly, the gas carrier exhausted from the flux tube 140 penetrates the porous member 21 and enters into the condensed carrier in a bubble state, thereby facilitating the liquefaction of the gas carrier.

Preferably, a plurality of spaced apart plates 22*a* and 22*b* are installed in the condensing vessel 211. The plates 22*a* and 22*b* suppress vigorous flux of the gas carrier induced into the condensing vessel 211, thereby facilitating the liquefaction thereof.

The liquid carrier in the condensing vessel 211 is maintained at a constant temperature by a peltier chip 212 which is a thermostat. The peltier chip 212 utilizes absorption of heat, generated when a current is applied to the contact point of different metals.

According to the present invention, the carrier liquefied in the condenser 20 circulates along the wall of the housing 121 of the drying unit 12. In other words, the condensing vessel 211 and the housing 121 are connected to each other by circulating tubes 221 and 222 for reciprocally circulating the liquefied carrier therebetween, by driving a pump 224. The input end of the circulating tube 221 and the output end of the circulating tube 222 are connected to the condensing vessel 211, and at least part of the circulating tube 221 is provided along and in contact with a wall of the housing 121.

Figure 4:
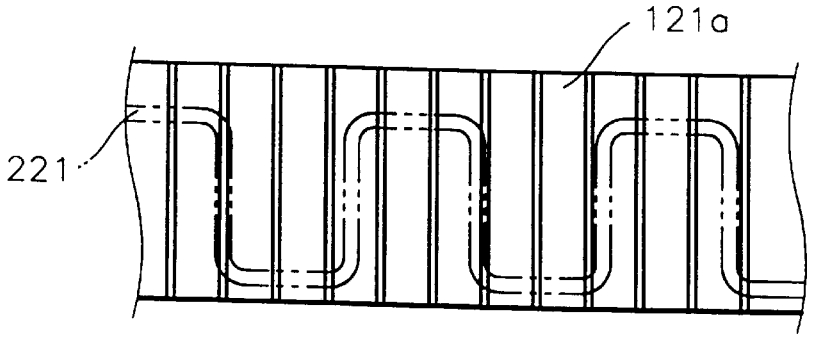
FIG. 4 is an enlarged view of portion "A" shown in FIG. 2.

As shown in FIG. 4, the circulating tube 221 contacts the heat transmission fins 121*a* formed in the housing 121. In this case, the heat transmission fins 121*a* exchange heat with the circulating tube 221 through which the liquid carrier of a relatively low temperature flows so as to be maintained at a temperature lower than the ambient temperature. Preferably, the circulating tube 221 extends through the heat transmission fins 121*a* in a zigzag fashion to increase the area for heat exchange.

In the operation of the liquid carrier recovery apparatus according to the present invention, while the drying roller 122 rotates in contact with the photoreceptor belt 11, the liquid carrier is absorbed from the developer liquid adsorbed onto the photoreceptor belt 11. The liquid carrier absorbed into the drying roller 122 is evaporated by the heating roller 123.

Subsequently, the evaporated carrier is cooled by the heat transmission fins 121*a* formed in the housing 121 of the drying unit 12 so that part of the evaporated carrier is liquefied. The transmission fins 121*a* exchange heat with the liquid carrier flowing from the condensing vessel 211 and through the circulating tube 221 such that the carrier is maintained at a lower temperature than the ambient temperature. Thus, much more gas carrier is liquefied quickly, as compared to the conventional method. Also, the remaining gas carrier, which is not liquefied, is maintained at a relatively low temperature. The liquefied carrier is recovered to the carrier reservoir 15 through the first recovery tube 124.

The flux fan 13*a*, rotated by the driving motor 13*b*, influences the remaining gas carrier to flow through the flux tube 140 and into the condensing vessel 211. The gas carrier passes through the porous member 21 coupled to the output end of the flux tube 140, and enters into the condensed carrier stored in the condensing vessel 211 in a fine bubble state. Here, the gas carrier is maintained at a relatively lower temperature than in a conventional apparatus. Therefore, more gas carrier can be liquefied quickly.

The porous member 21 distributes the gas carrier in a bubble state to increase the area for heat exchange. Also, the plate 22*b* causes the gas carrier bubbles distributed into the liquid carrier to remain in the liquid carrier for a length of time, thereby further facilitating the liquefaction thereof.

If the temperature of the liquid carrier of the condensing vessel 211 increases due to the induced gas carrier, a sensor (not shown) detects the increased temperature and transmits the detected signal to a controller (not shown). The controller controls the amount of current applied to the peltier chip 212, thereby maintaining the liquid carrier at a constant temperature.

Finally, the carrier liquefied in the condensing vessel 211 is recovered to the carrier reservoir 15 through a second recovery tube 141.

Any gas carrier remaining in the condenser is filtered by a filter 161 installed in the exhaust unit 16.

As described above, according to the carrier recovery apparatus for a liquid electrophotographic printer according to the present invention, a circulating liquid carrier and a gas carrier undergo a heat exchange with each other, thereby facilitating the cooling and liquefaction of the gas carrier. Therefore, the time required for carrier recovery is shortened, and the carrier recovery efficiency is improved.

What is claimed is:

1. A liquid carrier recovery apparatus for a liquid electrophotographic printer comprising:

a drying unit for evaporating a liquid carrier adsorbed onto a surface of a photoreceptor belt, thereby converting said liquid carrier into a gas carrier;

a flux tube extending from said drying unit for conveying at least a part of said gas carrier therethrough, said flux tube having an output end;

a condensing vessel connected to said output end of said flux tube, said condensing vessel storing a condensed carrier for condensing said gas carrier received via said flux tube;

a circulating tube connected to said drying unit and said condensing vessel, said circulating tube for reciprocally circulating said condensed carrier in said condensing vessel between said drying unit and said condensing vessel, such that heat exchange occurs between said condensed carrier and said gas carrier within said drying unit; and a carrier reservoir for receiving and storing said gas carrier condensed in said drying unit and said condensing vessel.

2. The liquid carrier recovery apparatus according to claim 1, wherein said drying unit includes a housing for accommodating said gas carrier, and wherein said circulating tube has an input end and an output end connected to said condensing vessel, and a heat exchanging portion coupled to said housing.

3. The liquid carrier recovery apparatus according to claim 2, wherein a heat transmission fin is formed on a wall of said housing, and said heat exchanging portion of said circulating tube contacts said heat transmission fin.

4. The liquid carrier recovery apparatus according to claim 3, wherein said heat exchanging portion of said circulating tube extends in a zigzag fashion to maximize a heat exchange surface area.

5. The liquid carrier recovery apparatus according to claim 1, wherein said output end of said flux tube is immersed in said condensed carrier in said condensing vessel.

6. The liquid carrier recovery apparatus according to claim 5, wherein a porous member for distributing the gas carrier into said condensed carrier in a bubble state is coupled to said output end of said flux tube.

7. The liquid carrier recovery apparatus according to claim 5, further comprising a plate submerged in said condensed carrier in said condensing vessel to obstruct an escape of said gas carrier from said condensed carrier.

8. The liquid carrier recovery apparatus according to claim 3, wherein a plurality of heat transmission fins are formed on a wall of said housing and said heat exchanging portion of said circulating tube contacts said plurality of said heat transmission fins.

* * * * *